US005984491A

United States Patent [19]

Chang

[11] Patent Number: 5,984,491

[45] Date of Patent: Nov. 16, 1999

[54] DECORATIVE CHRISTMAS TREE ILLUMINATION ASSEMBLY

[75] Inventor: Chin Chen Chang, Taiwa, China

[73] Assignee: Golden Bay Enterprises, Inc., Hempstead, N.Y.

[21] Appl. No.: 08/881,617

[22] Filed: Jun. 25, 1997

Related U.S. Application Data

[63] Continuation-in-part of application No. 08/650,800, May 20, 1996, Pat. No. 5,645,342.

[51] Int. Cl.[6] ..... F21P 1/00

[52] U.S. Cl. ..... 362/252; 362/391; 362/396

[58] Field of Search ..... 362/123, 227, 362/234, 249, 252, 806, 391, 396

[56] References Cited

U.S. PATENT DOCUMENTS 5,645,342 7/1997 Chang ..... 362/252
5,662,409 9/1997 Huang ..... 362/249

*Primary Examiner*—Stephen Husar

[57] ABSTRACT

A light assembly in the form of a net is provided which can be draped over a Christmas tree or other structures. The assembly includes a plurality of interconnected light bulbs seated within their respective sockets at the nodes formed by the interconnecting conductive, insulating wires which are energized by an electrical switch.

11 Claims, 4 Drawing Sheets

DECORATIVE CHRISTMAS TREE ILLUMINATION ASSEMBLY

RELATED APPLICATIONS

This application is a continuation-in-part of application Ser. No. 08/650,800 filed May 20, 1996, now U.S. Pat. No. 5,645,342.

FIELD OF THE INVENTION

This invention relates generally to decorative illumination of Christmas trees, and is particularly related to a Christmas tree light assembly made of a web or a net structure comprising a plurality of interconnected light elements. The net structure which comprises the interconnected light elements is pre-fabricated and adapted for draping as a single net over a Christmas tree or over different building structures.

BACKGROUND OF THE INVENTION

A variety of Christmas lights and decorative assemblies are available for illuminating and decorating Christmas trees. Conventional illumination of a Christmas tree involves the use of a plurality of separate elongated, insulative, electrically conductive wire strings on which are mounted several lighting elements (lamps) which are spaced apart from each other. Each of these lights element comprises a female socket member which is adapted to receive a screw-in or bayonet-type lamp, strung in series or in parallel. The strings are attached at one or both ends to an electrical plug which provides the source of electricity. See U.S. Pat. No. 5,057,976 issued to Sheila DuMong on Oct. 15, 1991. As mentioned in said patent, however, the mounting of such plurality of separate strings of lights on a Christmas tree is both is burdensome and time-consuming task. In order to simplify decoration of a Christmas tree by illumination, said patent provides a tree lighting assembly that incorporates a multiplicity of lamps in a net-like structure that can be readily mounted on a Christmas tree, and is easy to remove when not in use.

Other Christmas tree decorative illumination assemblies are described in the prior art patents disclosed in the DuMong patent. These are Crucefix U.S. Pat. No. 4,870,547 and Forrer U.S. Pat. No. 3,096,943. The DuMong patent also discloses two other patents, i.e., Ahoroni U.S. Pat. Nos. 4,720,773 and 4,736,282 which describe a mounting collar for use with conventional strings of Christmas lights.

In a more recent patent, i.e., U.S. Pat. No. 5,213,519 issued to David J. Dorfman on May 25, 1993, the patentee describes an electrical receptacle assembly which, in one embodiment, forms a flexible net. The receptacles receive light bulbs therein which, when illuminated, form a blanket of lights that can be draped over and around a Christmas tree.

Other decorative light assemblies for Christmas trees are disclosed in U.S. Pat. Nos. 4,720,773; 5,338,585; and 5,424,925.

A more recent decorative light assembly is described in a commonly assigned copending application Ser. No. 08/650,800.

The present invention describes a further improvement in decorative light assemblies which were described in the patents to illuminate Christmas trees.

SUMMARY OF THE INVENTION

It is an object of this invention to provide a Christmas tree illumination assembly that comprises multiplicity of interconnected lamps which form a net-like structure that can be draped over of Christmas tree.

It is another object of this invention to provide a Christmas tree illumination assembly of light bulbs the form of a net of different shapes and sizes for ready mounting over a Christmas tree, and which is easily removed therefrom.

It is still an object of this invention to provide a Christmas tree lighting and decorative assembly which is pre-fabricated as a unitary net structure, thus obviating the need for using a plurality of separate strings of lights and the usual difficulty of entanglements which is experienced when decorating a Christmas tree therewith.

It is yet another object of this invention to provide a decorative illumination assembly which is adapted to be draped over different building structures.

The foregoing and other objects of this invention will be more fully appreciated with reference to the ensuing detailed description of the invention taken in conjunction with the accompanying drawings.

BRIEF DESCRIPTION OF THE DRAWINGS

In the drawings wherein like reference numerals are used to designate like elements.

DETAILED DESCRIPTION OF THE DRAWINGS

Figure 1:
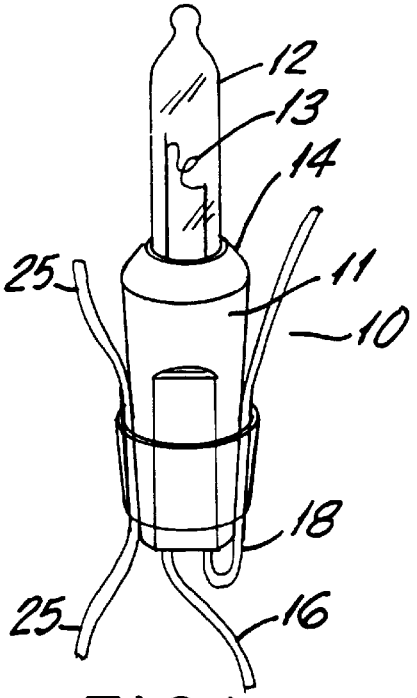
FIG. 1 is an enlarged perspective view of a Christmas tree lamp designed for use in the present invention.

Referring first to FIGS. 1–5, there is shown, in FIG. 1, a lamp structure generally designated as 10 suitable for use in the Christmas tree web assembly of the present invention. The lamp structure 10 comprises a cylindrical body 11, a bulb 12 having electrical filament 13 and the base 14 which fits into the socket 15 formed at the top of the cylindrical body 11.

A first elongated and electrically conductive, insulated wire 16 is attached, at one end, to a first metal plate member 17 in the socket 15 (see FIG. 5), and a second electrically conductive insulated wire 18 is attached to a second metal plate 19 also disposed within the socket 15. The bulb or lamp 12 has the plastic base 14 (see FIG. 4) with exposed wires 21 and 22 disposed on opposite sides of the base 14 and contact the metal plates 17 and 19.

Figure 2:
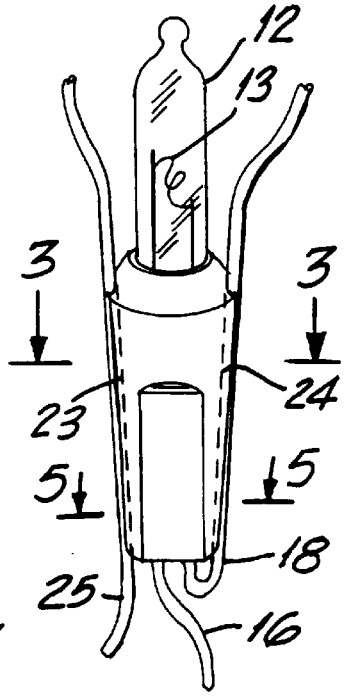
FIG. 2 is an enlarged perspective view of an alternative embodiment of a Christmas tree lamp suitable for use in the present invention.
Figure 3:
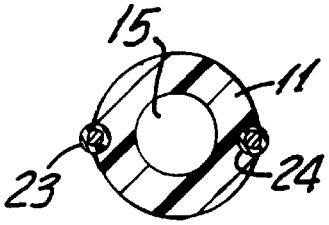
FIG. 3 is a cross-sectional view taken along the line 3—3 of FIG. 2.

In the embodiment shown in FIG. 2 and 3 the sides of the cylindrical body 11 include the elongated grooves 23, 24 disposed on opposite sides thereof, through which extend the wires 16 and 18, respectively.

Figure 6:
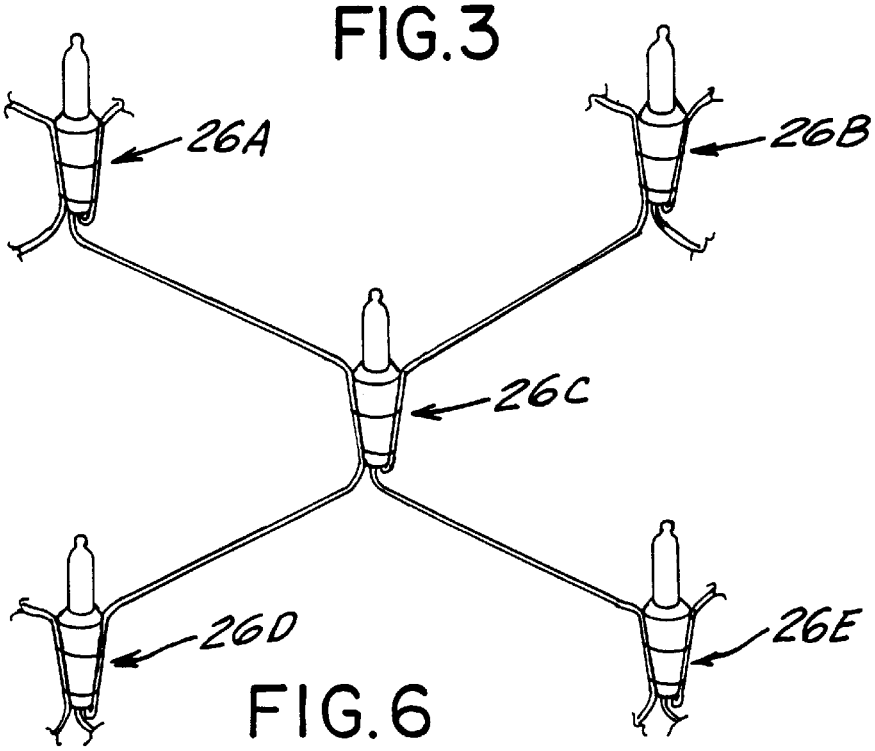
FIG. 6 is a perspective view of a partial assembly of the web formed by the interconnected lamps of the present invention.
Figure 4:
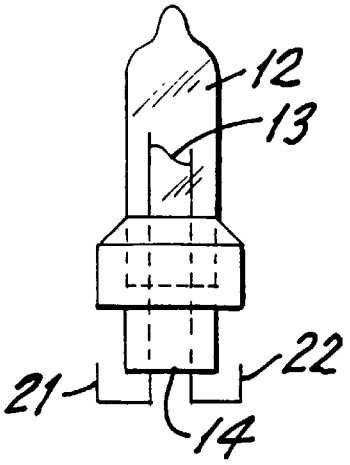
FIG. 4 is an enlarged perspective view of the light bulb shown in FIGS. 1 and 2.
Figure 5:
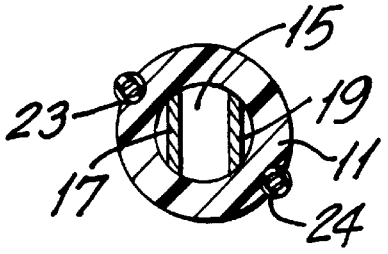
FIG. 5 is a cross-sectional view taken along the line 5—5 of FIG. 2.

As shown in FIGS. 1, 2 and 6, the wires 16 and 18 terminate in the cylindrical body 11 and are electrically connected to the bulb 12. The wire 25 is retained against the cylindrical body 11 by a polyvinylchloride (PVC) cover sleeve or a suitable adhesive tape, which also serves to retain the wire 18 against the other sides of the base, but which is not electrically connected to the bulb 12.

Figure 7:
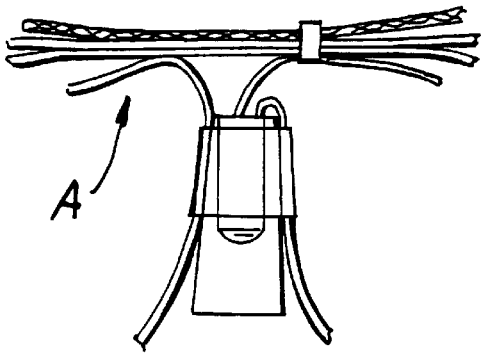
FIG. 7 is an enlarged side view showing the connection of a lamp base with the electrical wires of the lighting assembly.
Figure 8:
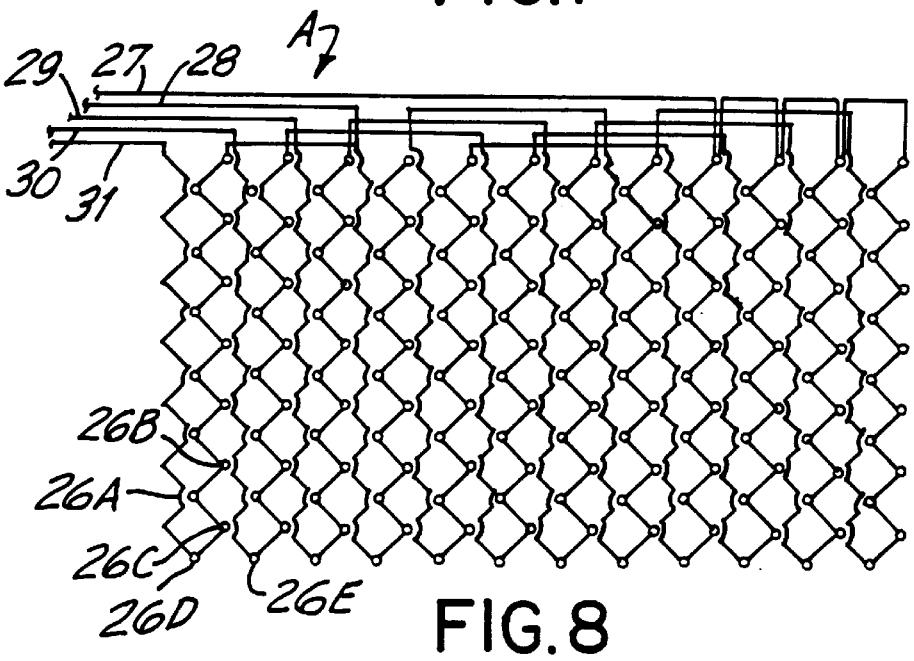
FIG. 8 is a top plan view of the web of Christmas tree lights arranged in accordance with one embodiment of this invention.

As shown in FIGS. 7 and 8, the web of interconnected light structure consists of a plurality of bulbs 12 such as shown in FIGS. 1–3, and wires which physically and electrically interconnect these lamps. The bulbs 12 form the nodes 26A–26N in the web, wherein N is an integer number representing the number of desired lamps. In the embodiment shown in FIG. 6 only nodes 26A–26E are shown but it can be appreciated that the net structure can include as few as 10 and as many as 200 or more nodes depending on the desired size of the web and number of lamps used in the web.

Figure 10:
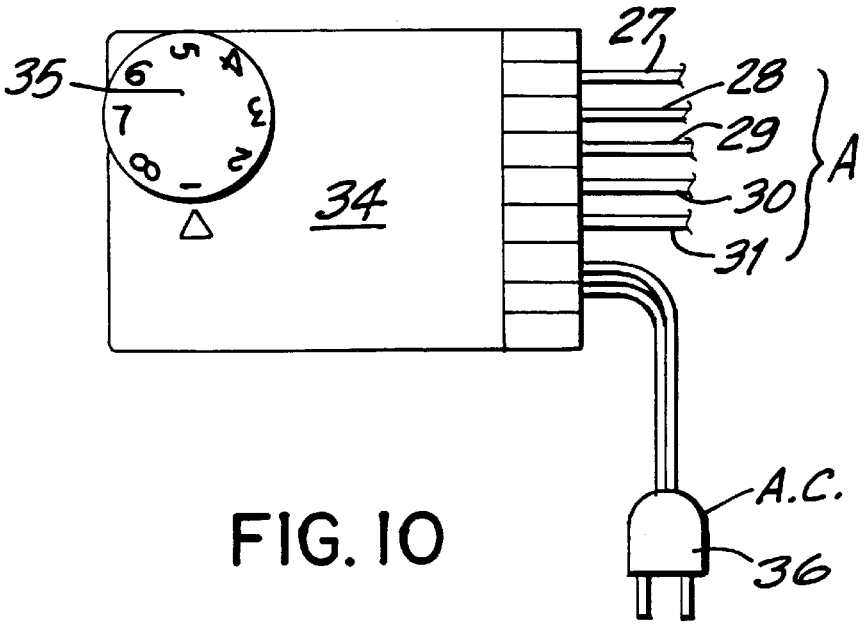
FIG. 10 is a top view of the electrical control box which provides the source of energy for the web of interconnected lights of the present invention.

In the embodiments shown in FIGS. 7 and 8, the web is formed such that it has five wires 27, 28, 29, 30 and 31 leading into an electrical control switch 32 as shown in FIG. 10.

Figure 9:
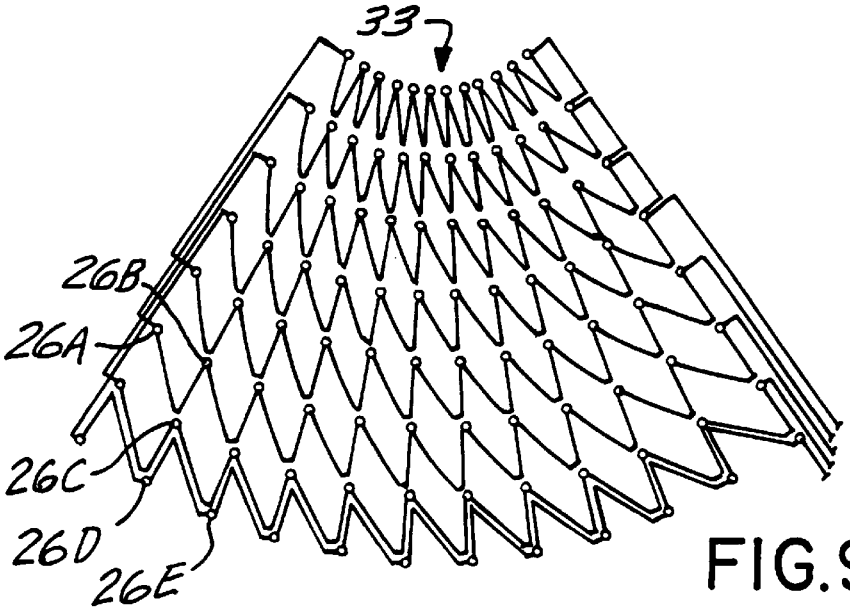
FIG. 9 is a view showing an alternative arrangement of the web of Christmas tree lights used in accordance with a different embodiment of this invention.

In the embodiment illustrated in FIG. 9 the web is formed into a general conical shape having a base 33 which is wider than its top section 32. As in the embodiment of FIG. 8, the web includes five wires 27A, 28A, 29A 30A and 31A which lead to the electrical control switch 34.

Figure 11B:
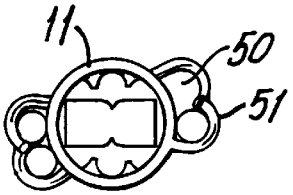
FIG. 11B is a top view of FIGS. 11A.
Figure 11A:
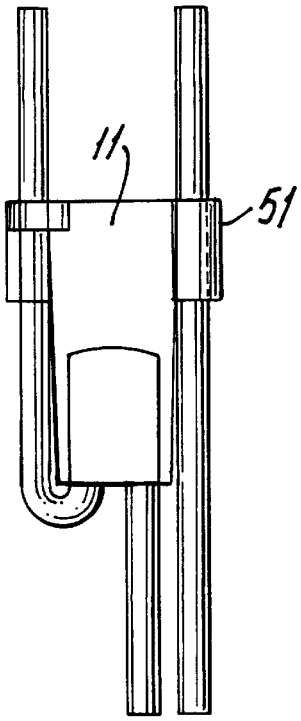
FIG. 11A is an elevational view showing a modification of the structure shown in FIG. 7 illustrating another embodiment of connection of the lamp base with the electrical wires of the lighting assembly.
Figure 11C:
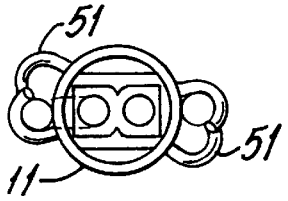
FIG. 11C is a bottom view of FIG. 11A.

Referring FIGS. 11A, 11B and 11C which show a modification of the present invention, the sides of the cylindrical body 11 is provided with fasteners in the form of wire receiving openings 50 formed in hollow extensions 51 extending from the sides of the cylindrical body 11. The extensions 51 are shown as extending from opposite sides of the cylindrical body 11. The insulated wires extend along both of the fasteners.

Figure 12B:
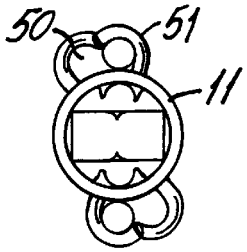
FIG. 12B is a top view of FIG. 12A.
Figure 12A:
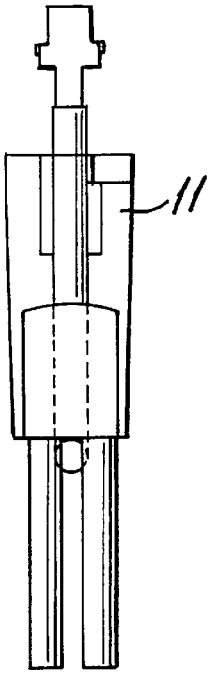
FIG. 12A is yet another modification of the lighting assembly shown in FIG. 11A.
Figure 12C:
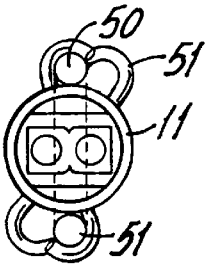
FIG. 12C is a bottom view of FIG. 12A.

In the embodiment shown in FIGS. 12A, 12B and 12C, which is similar to the embodiment shown in FIGS. 11A, 11B and 11C, the insulated wires extend from the cavity itself.

Figure 13B:
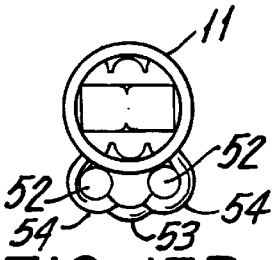
FIG. 13B is a top view of FIG. 13A.
Figure 13A:
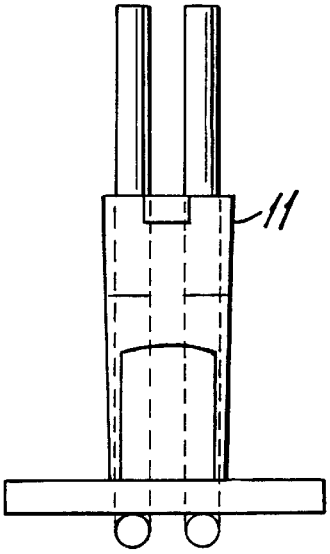
FIG. 13A is still another embodiment of the lighting assembly shown in FIG. 11A.
Figure 13C:
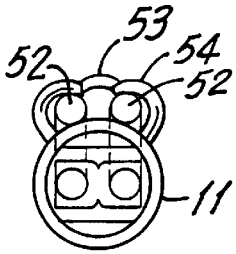
FIG. 13C is a bottom view of FIG. 13A.

In the embodiment shown in FIGS. 13A, 13B and 13C, the hollow extensions 54 are spaced from each other and connected to each other by a bridge 53 with the wires being parallel to each other and extending through the openings 52 in extensions 54.

In using the various modifications of the cylindrical body 11 described hereinabove it will be understood that the same web may use a variety of these cylindrical bodies.

The electrical control switch 32 has an integrated circuit and a control dial 35. This switch may be connected to a household power source, usually 110 volt AC, through conventional electrical plug 36. The control switch is provided with the control dial 35 marked with numerical indicia of from 1 to 8 which correspond to:

1. combination
2. in wave
3. sequential
4. slo-glo
5. sparkling/chasing
6. fade on/off
7. sparkling
8. steady burn The dial can be set to the desired numerical indicia in order to obtain the desired illumination results.

While the present invention has been described with some degree of particularity, it is readily apparent that many changes and modifications may be suggested which are nevertheless within the scope and contemplation of this invention. For example, the web or net structure need not necessarily be conical but may be rectangular, square or in other desired configurations. Also, the decorative net may be used to illuminate structures other than Christmas trees such as, for example, walls, buildings and other structures.

What is claimed is:

1. A decorative Christmas tree light assembly comprising a web including a plurality of Christmas tree light bulbs, the web being adapted to be draped over a Christmas tree; the assembly comprising;

(a) at least three pairs of insulated wires, each pair of insulated wires comprising a first insulated wire and a second insulated wire;

(b) said wires being formed into the web with the wires crossing at nodes of the web;

(c) a socket being positioned at least at about every node of the web;

(d) a cylindrical body in which the socket is formed;

(e) said socket is joined at each node to a wire passing through that node;

(f) said wire is mounted on said cylindrical body by a fastener;

(g) said fastener comprising wire receiving openings extending from said cylindrical body.

2. An assembly as set forth in claim 1 wherein said wire receiving openings extend from opposite sides of said cylindrical body.

3. An assembly as set forth in claim 1 wherein a pair of wire receiving openings are provided.

4. An assembly as set forth in claim 1 wherein said wire receiving openings are spaced from each other but connected together by a bridge element.

5. A light bulb receiving structure for a Christmas tree light assembly having at least one insulated wire which comprises a cylindrical body having sides, a socket in said cylindrical body, said wire is mounted on said cylindrical body by a fastener, wherein said fastener comprises wire receiving openings extending from said sides.

6. A structure as set forth in claim 5 wherein a pair of wire receiving openings are provided.

7. A structure as set forth in claim 5 wherein said wire receiving openings are spaced from each other but connected together by a bridge element.

8. A decorative light assembly comprising a web including a plurality of light bulbs, said webs being adapted to be draped over a structure, said assembly comprising:

a) at least three pairs of insulated wires, each pair of insulated wires comprising a first insulated wire and a second insulated wire;

b) said wires being formed into the web with the wires crossing at nodes of the web;

c) a socket being positioned at least at about every node of the web;

d) a cylindrical body in which the socket is formed;

e) said socket is joined at each node to a wire passing through said node;

f) said wire is mounted on said cylindrical body by a fastener;

g) said fastener comprises wire receiving openings extending from said cylindrical body.

9. An assembly as set forth in claim 8 wherein said wire receiving openings extend from opposite sides of said cylindrical body.

10. An assembly as set forth in claim 8 wherein a pair of wire receiving openings are provided.

11. An assembly as set forth in claim 8 wherein said wire receiving openings are spaced from each other but connected together by a bridge element.

* * * * *